US006602359B1

(12) United States Patent
Ochi et al.

(10) Patent No.: US 6,602,359 B1
(45) Date of Patent: Aug. 5, 2003

(54) BAR OR WIRE PRODUCT FOR USE IN COLD FORGING AND METHOD FOR PRODUCING THE SAME

(75) Inventors: Tatsuro Ochi, Muroran (JP); Hideo Kanisawa, Muroran (JP); Ken-ichiro Naito, Muroran (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/914,128

(22) PCT Filed: Dec. 22, 2000

(86) PCT No.: PCT/JP00/09166

§ 371 (c)(1),
(2), (4) Date: Aug. 22, 2001

(87) PCT Pub. No.: WO01/48258

PCT Pub. Date: Jul. 5, 2001

(30) Foreign Application Priority Data

Dec. 24, 1999 (JP) ..... 11-366553
Aug. 30, 2000 (JP) ..... 2000-261689

(51) Int. Cl.[7] ..... C22C 38/02; C22C 38/04; C22C 38/06; C21D 8/06

(52) U.S. Cl. ..... 148/330; 148/595; 148/598; 148/599

(58) Field of Search ..... 148/330, 595, 148/598, 599

(56) References Cited

FOREIGN PATENT DOCUMENTS

| | | |
|---|---|---|
| EP | 0508237 | 10/1992 |
| JP | 57-63638 | 4/1982 |
| JP | 60-114517 | 6/1985 |
| JP | 60-152627 | 8/1985 |
| JP | 61-264158 | 11/1986 |
| JP | 62-13523 | 1/1987 |
| JP | 62-139817 | 6/1987 |
| JP | 64-25918 | 1/1989 |
| JP | 7-268546 | 10/1995 |
| JP | 9-287056 | 11/1997 |

OTHER PUBLICATIONS

Toshizo Tarui, et al., "Chokusetsu Nanshitsuka Senzai no Kyuodo Ensei no oyobosu Goukin Genso no Eikyou", Zairyou to Process, vol. 4 (1991), No. 3–2040.*
JIS—G—0551, Method of Austenite Grain Size Determination For Steel, pp 422–443, (1998).
JIS—G—0552, Method of Ferrite Grain Size Test For Steel, pp 187–198, (1977).
JIS—G—3539, Carbon Steel Wires For Cold Heading And Cold Forging, pp 1577–1586, (1991).

*Primary Examiner*—Deborah Yee
(74) *Attorney, Agent, or Firm*—Kenyon & Kenyon

(57) ABSTRACT

The present invention provides a steel bar or wire rod for cold forging excellent in ductility after spheroidizing annealing and capable of preventing the occurrence of cracking in the steel material during cold forging, which cracking has so far been a problem when manufacturing machine structural components by cold forging, and a method to produce the same. Specifically, a steel bar or wire rod for cold forging according to the present invention has a chemical composition comprising, in mass, 0.1 to 0.65% of C, 0.01 to 0.5% of Si, 0.2 to 1.7% of Mn, 0.001 to 0.15% of S, 0.015 to 0.1% of Al, 0.0005 to 0.007% of B, and the restricted elements of 0.035% or less of P, 0.01% or less of N and 0.003% or less of O, with the balance consisting of Fe and unavoidable impurities, and is characterized in that: the area percentage of ferrite structure is 10% or less at the portion from the surface to the depth of 0.15 time the radius of the steel bar or wire rod; the other portion consists substantially of one or more of martensite, bainite and pearlite; and further the average hardness of the portion from the depth of 0.5 time its radius to its center is less than the hardness of its surface layer (the portion from the surface to the depth of 0.15 times the radius) by HV 20 or more.

9 Claims, 5 Drawing Sheets

25μm

25μm

BAR OR WIRE PRODUCT FOR USE IN COLD FORGING AND METHOD FOR PRODUCING THE SAME

TECHNICAL FIELD

The present invention relates to a steel bar or wire rod, for cold forging, used for manufacturing machine structural components such as those of cars and construction machines and a method to produce the same. More specifically, the present invention relates to a steel bar or wire rod, for cold forging, excellent in ductility and suitable for the cold forging by heavy working and a method to produce the same.

BACKGROUND ART

Carbon steels for machine structural use and low alloy steels for machine structural use have conventionally been used as structural steel materials for manufacturing machine structural components such as those of cars and construction machines. Machine structural components such as bolts, rods, engine parts and driving system components for cars have so far been manufactured from these steel materials mainly through hot forging and machining processes. A recent trend, however, is that the above processes are replaced with a cold forging process for the sake of enhanced productivity and other advantages. In a cold forging process, cold forging is usually applied to hot rolled steel materials after spheroidizing annealing (SA) is applied to secure cold workability. A problem in the cold forging is, however, that the steel materials are hardened by working and their ductility is lowered, resulting in the occurrence of cracks and a shorter service life of metal dies. In case of heavy cold forging in particular, cracking during cold forging, namely the insufficient ductility of steel materials, is often the main hindrance to changing the process from hot forging to cold forging.

Meanwhile, since the spheroidizing annealing (SA) requires high temperature heating and a long retention time of steel materials, it not only requires a heat treatment facility such as a reheating furnace but also consumes energy for the heating, and therefore the process accounts for a large proportion of the total manufacturing cost. To cope with this, various technologies have been proposed from the viewpoints of productivity improvement, energy saving, etc.

Some examples are as follows: Japanese Unexamined Patent Publication No. S57-63638 proposes a method to shorten the time for spheroidizing annealing and obtain a steel wire rod excellent in cold forging by cooling a steel material to 600° C. at a cooling rate of 4° C./sec. or higher after hot-rolling to form a quenched structure and then applying spheroidizing annealing to the steel material covered with scale in an inert gas atmosphere; Japanese Unexamined Patent Publication No. S60–152627 proposes a method to enable quick spheroidizing by regulating finish rolling conditions, rapidly cooling the steel material after the rolling and forming a structure in which fine pearlite, bainite or martensite is intermingled with finely dispersed proeutectoid ferrite; Japanese Unexamined Patent Publication No. S61-264158 proposes a method to lower the steel hardness after spheroidizing annealing by improving steel chemical composition, namely obtaining a low carbon steel having a reduced P content of 0.005% or less and satisfying $Mn/S \geqq 1.7$ and $Al/N \geqq 4.0$; and Japanese Unexamined Patent Publication No. S60-114517 proposes a method to eliminate a softening annealing process before cold working by applying a controlled rolling.

All these conventional technologies aim at improving or eliminating the spheroidizing annealing before cold forging and do not aim at improving the insufficient ductility of steel materials, which is the main hindrance to changing the process from hot forging to cold forging in the manufacture of machine components requiring heavy working.

DISCLOSURE OF THE INVENTION

In view of the above situation, the object of the present invention is to provide a steel bar or wire rod for cold forging excellent in ductility after spheroidizing annealing and capable of preventing the occurrence of cracking in the steel material during cold forging which has, so far, been a problem when manufacturing machine structural components by cold forging after applying spheroidizing annealing to a hot-rolled steel bar or wire rod, and a method to produce the same.

The inventors of the present invention discovered, as a result of investigating the cold workability of a steel bar or wire rod for cold forging, that it was possible to obtain a steel bar or wire rod for cold forging excellent in ductility after spheroidizing annealing by hardening only the surface layer of a steel bar or wire rod having a specific chemical composition and softening the structure of its center portion.

The gist of the present invention, which has been established on the basis of the above finding, is as follows:

(1) A steel bar or wire rod for cold forging excellent in ductility after spheroidizing annealing, having a chemical composition comprising, by mass, 0.1 to 6.65% of C, 0.01 to 0.5% of Si, 0.2 to 1.7% of Mn, 0.001 to 0.15% of S, 0.015 to 0.1% of Al, 0.0005 to 0.007% of B, and the restricted elements of 0.035% or less of P, 0.01% or less of N and 0.003% or less of O, with the balance consisting of Fe and unavoidable impurities, characterized in that: the area percentage of ferrite structure is 10% or less at the portion from the surface to a depth of 0.15 times the radius of the steel bar or wire rod; the other portion consists substantially of one or more of martensite, bainite and pearlite; and further the average hardness of the portion from the depth of 0.5 times its radius to its center is less than the hardness of its surface layer (the portion from the surface to the depth of 0.15 time the radius) by HV 20 or more.

(2) A steel bar or wire rod for cold forging excellent in ductility after spheroidizing annealing according to the item (1), characterized by further containing 0.2 mass % or less of Ti.

(3) A steel bar or wire rod for cold forging excellent in ductility after spheroidizing annealing according to the item (1) or (2), characterized by further containing, by mass, one or more of 3.5% or less of Ni, 2% or less of Cr and 1% or less of Mo.

(4) A steel bar or wire rod for cold forging excellent in ductility after spheroidizing annealing according to any one of the items (1) to (3), characterized by further containing, by mass, one or both of 0.005 to 0.1% of Nb and 0.03 to 0.3% of V.

(5) A steel bar or wire rod for cold forging excellent in ductility after spheroidizing annealing according to any one of the items (1) to (4), characterized by further containing, by mass, one or more of 0.02% or less of Te, 0.02% or less of Ca, 0.01% or less of Zr, 035% or less of Mg, 0.1% or less of Y and 0.15% or less of rare earth elements.

(6) A steel bar or wire rod for cold forging excellent in ductility after spheroidizing annealing 15 according to any one of the items (1) to (4), characterized in that.the austenite grain size number according to Japanese Industrial Standard (JIS) is 8 or larger at the portion from the surface to the depth of 0.15 times the radius of the steel bar or wire rod.

(7) A method to produce a steel bar or wire rod for cold forging excellent in ductility after spheroidizing annealing, characterized by finish-hot-rolling a steel having a chemical composition specified in any one of items (1) to (5) in a manner to control its surface temperature to 700 to 1,000° C. at the exit from the final finish rolling stand and then subjecting it to at least one or more process cycles consisting of rapid cooling to a surface temperature of 600° C. or below and recuperation by its sensible heat to a surface temperature of 200 to 700° C., so that the area percentage of ferrite structure is 10% or less at the portion from the surface to the depth of 0.15 times the radius of the steel bar or wire rod, the other portion consists substantially of one or more of martensite, bainite and pearlite, and further the average hardness of the portion from the depth of 0.5 times its radius to its center is less than the hardness of its surface layer (the portion from the surface to the depth of 0.15 times the radius) by HV 20 or more.

(8) A steel bar or wire rod for cold forging excellent in ductility, characterized in that the steel bar or wire rod is subjected to spheroidizing annealing like any one of the items (1) to (6), the degree of spheroidized structure defined by JIS G 3539 is within No.2 at the portion from the surface to the depth of 0.1.5 time the radius of the steel bar or wire rod and, in addition, the degree of spheroidized structure is within No. 3 at the portion from the depth of 0.5 time its radius to its center.

(9) A steel bar or wire rod for cold forging excellent in ductility according to the item (8), characterized in that the ferrite grain size number under JIS is 8 or larger at the portion from the surface to the depth of 0.15 times the radius of the steel bar or wire rod.

BEST MODE FOR CARRYING OUT THE INVENTION

Figure 1:
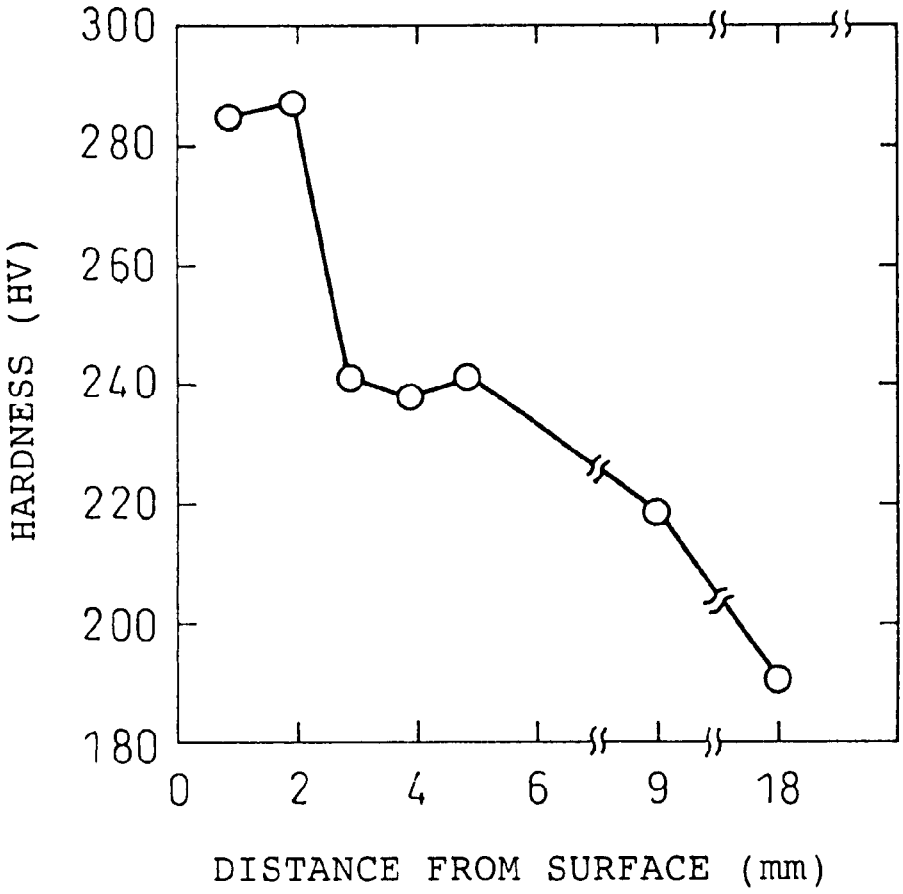
FIG. 1 is a graph showing the relationship between the distance (mm) from the surface and the hardness (HV) of a steel bar for cold forging (C: 0.48%), according to the present invention, having the diameter of 36 mm.

The present invention is explained in detail hereafter.

In the first place, explained are the reasons why the steel chemical composition is defined as above to realize the structure and the mechanical properties such as hardness and ductility of a steel bar or wire rod for cold forging envisaged in the present invention.

C is indispensable for increasing steel strength so as to be suitable for machine structural components and, with a C content less than 0.1%, the strength of the final products is insufficient but, with a C content in excess of 0.65%, the ductility of the final products is deteriorated. The C content is, therefore, limited to 0.1 to 0.65%. In particular, it is preferable to control the content of C in the range from 0.2 to 0.4% in case of bolts and other mechanical components requiring quenching, from 0.1 to 0.35% in case of those requiring carburization quenching, and from 0.3 to 0.65% in case of those requiring induction quenching.

Si is added as a deoxidizing agent and for increasing the strength of final products through solid solution hardening. A content of Si below 0.01% is insufficient for obtaining the above effects but, when it is added in excess of 0.5%, these effects do not increase any more and, adversely, ductility is lowered. For this reason, the content of Si is defined as 0.01 to 0.5%. It is, however, preferable to set an upper limit of the Si content at 0.2% or lower, more preferably, at 0.1% or lower.

Mn is effective for increasing the strength of the final products through the enhancement of hardenability but, with a content of Mn less than 0.2%, a sufficient effect is not obtained and, with its addition in excess of 1.7%, the effect becomes saturated and, adversely, ductility is lowered. The Mn content is, therefore, limited to 0.2 to 1.7%.

S is inevitably included in steel and exists there in the form of MnS. Its content is defined in the present invention as 0.001 to 0.15% since S contributes to the improvement of machinability and the formation of fine crystal structure. However, since S deteriorates ductility and thus is detrimental to cold forming work, it is preferable to limit its content to 0.015% or lower, more preferably, to 0.01% or lower, when machinability is not required.

Al is effective as a deoxidizing agent. It is also effective for fixing solute N in steel in the form of AlN and securing solute B. With an excessive content of Al, however, an excessive amount of $Al_2O_3$ is formed, resulting in the increase of internal defects and the deterioration of cold workability. The content of Al is limited in the present invention to the range from 0.015 to 0.1% for the above reason. Note that it is preferable to control the Al content to 0.04 to 0.1% when Ti, which serves to fix the solute B, is not added.

B precipitates in the form of $Fe_{23}(CB)_6$, which is a chemical compound of B, at the $\alpha/\gamma$ interface during the cooling process after spheroidizing annealing, contributing to softening the steel and enhancing cold workability by accelerating the growth of ferrite and broadening the distances among spheroidal carbides. Besides, the solute B precipitates at grain boundaries to enhance hardenability. For these reasons, the content of B is defined as 0.0005 to 0.007%.

P is inevitably included in steel, but it causes grain boundary segregation and center segregation, deteriorating ductility. It is, therefore, desirable to limit the content of P to 0.035% or less, or, more preferably, 0.02% or less (including 0%).

N is also inevitably included in steel. Since it is a detrimental element which reacts with B to form BN and lowers the effect of B, its content has to be 0.01% or less or, preferably, 0.007% or less.

O is inevitably included in steel, too, and deteriorates cold workability by reacting with Al to form $Al_2O_3$. It is therefore desirable to control its content to 0.003% or lower or, preferably, 0.002% or lower (including 0%).

The basic chemical composition of steel intended for the present invention is as described above. Further, in the present invention, Ti is added to fix N in the form of TiN and make N harmless. Since Ti is also effective as a deoxidizing agent, it is added to 0.2% or less, as deemed necessary. Further, one or more of Ni, Cr and Mo are added for the purpose of increasing the strength of final products through the enhancement of hardenability and other effects. An addition of these elements in great quantities, however, raises steel hardness through the formation of bainite and martensite at the center portion of an as hot-rolled steel bar or wire rod, and is not economical. The contents of these elements, therefore, are limited as follows: 3.5% or less for Ni, 2% or less or, preferably, 0.2% or less for Cr, and 1% or less for Mo.

In addition, for the purpose of controlling the crystal grain size, one or both of Nb and V may be added to steel according to the present invention. When the content of Nb is below 0.005% or that of V is below 0.03%, however, a sufficient effect is not obtained but, on the other hand, when their contents exceed 0.1 and 0.3%, respectively, the effect is saturated and, adversely, ductility is lowered. Hence, their contents are defined as 0.0005 to 0.1% for Nb and 0.03 to 0.3% for V.

Further, steel according to the present invention may contain one or more of 0.02% or less of Te, 0.02% or less of Ca, 0.01% or less of Zr, 0.035% or less of Mg, 0.15% or less of rare earth elements and 0.1% or less of Y for the purposes of controlling the shape of MnS, preventing cracks and enhancing ductility. Each of these elements forms oxides, and the oxides not only act as nuclei for the formation of MnS but also reform MnS into (Mn, Ca)S, (Mn, Mg)S, etc. Since this makes the sulfides easily stretchable during hot rolling and makes granular MnS disperse in fine grains, ductility is improved and the critical compressibility during cold forging is also improved. On the other hand, when Te is added in excess of 0.02%, Ca in excess of 0.02%, Zr in excess of 0.01%, Mg in excess of 0.035%, Y in excess of 0.1%, and/or rare earth elements in excess of 0.15%, the above effects are saturated and, adversely, ductility is deteriorated as a result of the formation of coarse oxides such as CaO, MgO, etc., clusters of these oxides and the precipitation of hard compounds such as ZrN and the like. For this reason, the contents of these elements are defined as 0.02% or less for Te, 0.02% or less for Ca, 0.01% or less for Zr, 0.035% or less for Mg, 0.1% or less for Y, and 0.15% or less for rare earth elements. Note that the rare earth elements are the elements having the atomic numbers of 57 to 71.

Here, the Zr content in steel is determined by inductively coupled plasma emission spectrometry (ICP), in a manner similar to the determination of Nb content in steel, after sample treatment in the same manner as specified in Attachment 3 of JIS G 1237-1997. The samples used in the measurement of the examples of the present invention are 2g per steel grade and the calibration curves for the ICP are set so as to be suitable for measuring a very small quantity of Zr. Namely, solutions having different Zr concentrations are prepared by diluting the standard Zr solution so that the Zr concentrations vary from 1 to 200 ppm, and the calibration curves are determined by measuring the amounts of Zr in the solutions. The common procedures related to the ICP are in accordance with JIS K 0116-1995 (General Rules for Emission Spectrometry) and JIS Z 8002-1991 (General Rules for Tolerances of Tests and Analyses).

Next, the structure of a steel bar or wire rod according to the present invention is explained hereafter.

The present inventors studied methods to enhance the ductility of a steel bar or wire rod for cold forging and clarified that the key to enhancing the ductility of spheroidizing-annealed steel materials was to make the spheroidizing-annealed structure uniform and fine, and, to this end, it was effective to suppress the ferrite percentage in the structure after hot rolling to a specified percentage or less and make the balance a mixed structure consisting of one or more of fine martensite, bainite and pearlite. For this reason, the ductility of a steel bar or wire rod improves when it undergoes rapid cooling after hot finish rolling and then spheroidizing annealing. However, when a steel bar or wire rod is rapidly cooled and hardened throughout the cross section of the structure, quenching cracks are likely to occur, steel hardness does not decrease even after spheroidizing annealing, cold deformation resistance increases, and thus the service life of cold forging dies becomes shorter. The present inventors discovered that, to solve this problem, it was effective to rapidly cool the surface layer of a steel bar or wire rod after hot finish rolling, then let it recuperate by its sensible heat so as to soften the martensite formed in the surface layer by tempering prior to spheroidizing annealing, and keep the structure of the internal portion softer, as a result of a slower cooling rate, than that of the surface layer, and, by doing so, a steel bar or wire rod for cold forging excellent in ductility after spheroidizing annealing and having low cold deformation resistance could be obtained.

FIG. 1 is a graph showing the relationship between the distance (mm) from the surface and the hardness (HV) of a steel bar for cold forging (C: 0.48%) according to the present invention having the diameter of 36 mm.

As shown in FIG. 1, the average hardness of the surface layer is HV 285 and that at the center is HV 190. The hardness of the center portion is greatly lower than that of the surface, the difference being approximately HV 100.

Figure 2A:
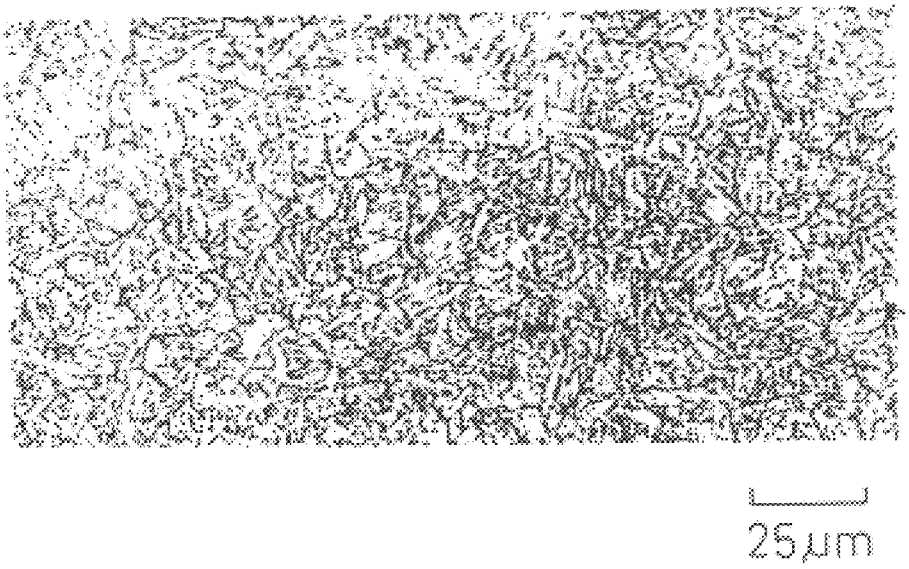
FIG. 2(*a*) is a micrograph (×400) of the surface of a steel bar and FIG. 2(*b*) is another of its center.
Figure 2B:
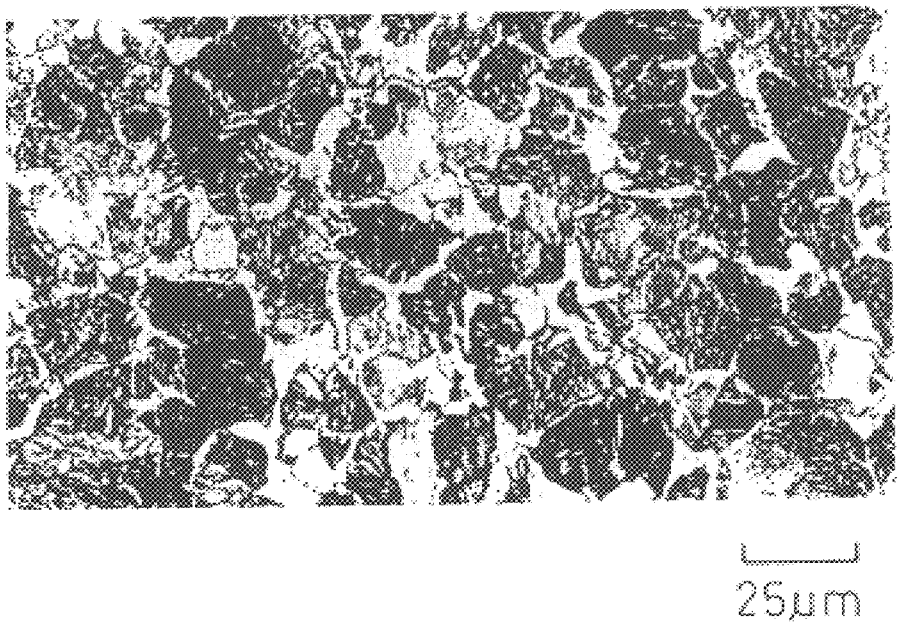

As for the structure, as shown in the micrographs (×400) of the surface layer in FIG. 2(*a*) and the center in FIG. 2(*b*), the surface layer is mainly composed of tempered martensite and the center portion mainly of ferrite and pearlite.

Figure 3A:
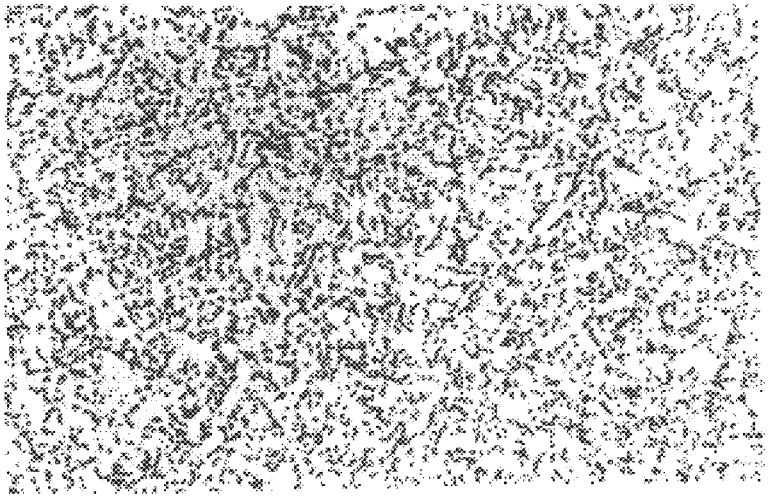
FIG. 3(*a*) is a micrograph (×400) of the surface of the steel bar shown in FIG. 1 after spheroidizing annealing, and FIG. 3(*b*) is another of its center.
Figure 3B:
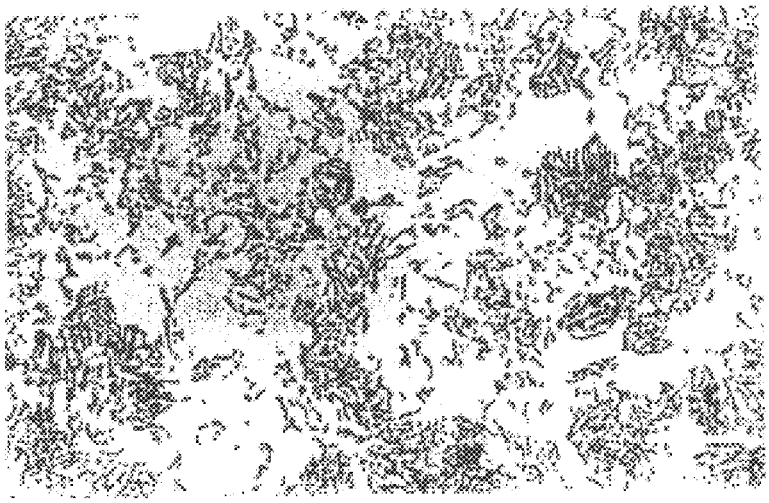

As for the structures obtained after holding the steel bar of FIG. 1 at 745° C. for 3 hr. and applying spheroidizing annealing by slow-cooling at a cooling rate of 10° C./hr., as shown in the micrographs (×400) of the surface in FIG. 3(*a*) and the center in FIG. 3(*b*), the structure of the surface is well spheroidized and homogeneous. The hardness after the spheroidizing annealing is approximately HV 130 and the difference in hardness between the surface and the center is as small as about HV 10.

The steel bar after the spheroidizing annealing was subjected to an upsetting test, under heavy working, at a true strain exceeding 1. However, no cold forging cracks were generated and cold deformation resistance remained at a low level and did not cause any problem in cold forging work.

Then, the present inventors proceeded with tests and examinations on the relationship between the structure of the surface layer and the hardness of the surface layer and the center portion to clarify the conditions where cracks were not generated even in cold forging.

As a result, the present inventors discovered the following: cold forging cracks could not be prevented unless the area percentage of ferrite structure was 10% or less, preferably 5% or less in case of cold forging requiring heavy working, at the portion from the surface to the depth of 0.15 times the radius of a steel bar or wire rod, even if the surface layer was composed of a tempered martensite structure (a structure in which ferrite exists in a phase consisting substantially of one or more of martensite, bainite and pearlite); for securing ductility to prevent cracks from occurring during cold forging and deformation resistance from increasing, it was necessary to form a fine and homogeneous structure having a higher percentage of tempered martensite in the surface layer at the stage of an as rolled steel bar or wire rod; and to do so, it was necessary to create a difference in hardness between the surface layer and the center portion at the stage of an as rolled steel bar or wire rod, and it was indispensable to make the average hardness (HV) of the portion from the depth of 0.5 times the radius of the steel bar or wire rod to its center less than the average hardness (HV) of the portion from the surface to the depth of 0.15 times the radius by HV 20 or more, preferably, by HV 50 or more in case of cold forging requiring heavy working.

Then, when the above steel bar or wire rod is subjected to spheroidizing annealing (SA), obtained is a steel bar or wire rod for cold forging excellent in ductility, wherein the degree of spheroidized structure defined by JIS G 3539 is within No. 2 (the spheroidized structure substantially does not contain lamellar pearlite structure) at the portion from the surface to a depth of 0.15 times the radius of the steel bar or wire rod and, in addition, the degree of spheroidized structure is within No. 3 (the area ratio of the lamellar pearlite structure is less than 10% with the remainder a spheroidized structure) at the portion from a depth of 0.5 times its radius to its center. It was confirmed that the spheroidizing-annealed steel bar or wire rod thus obtained does not develop cold forging cracks even in an upsetting test, under heavy working, with a true strain exceeding 1.

Note that conventionally known methods for spheroidizing annealing can be employed for the spheroidizing annealing of the present invention.

In order to obtain a crystal grain size of the surface layer which contributes to the enhancement of ductility, it is enough to make the austenite crystal grain size number (JIS G 0551) before spheroidizing annealing equal to or larger than 8 (less than 20 $\mu$m) at the portion from the surface to a depth of 0.15 times the radius of the steel bar or wire rod, and it is preferable to make the number equal to or larger than 9 (less than 14 $\mu$m) when better properties are required and, further, equal to or larger than 10 (less than 10 $\mu$m) when yet higher properties are required. In addition to the above, after the spheroidizing annealing, it is enough to make the ferrite crystal grain size number (JIS G 0552) equal to or larger than 8 (less than 20 $\mu$m) at the portion from the surface to the depth of 0.15 times the radius of the steel bar or wire rod, and it is preferable to make the number equal to or larger than 9 (less than 14 $\mu$m) when better properties are required, and, further, equal to or larger than 10 (less than 10 $\mu$m) when yet higher properties are required.

When the crystal grain size numbers are below the above specifications, sufficient ductility is not achieved.

The method to produce a steel bar or wire rod for cold forging according to the present invention is explained hereafter.

Figure 4:
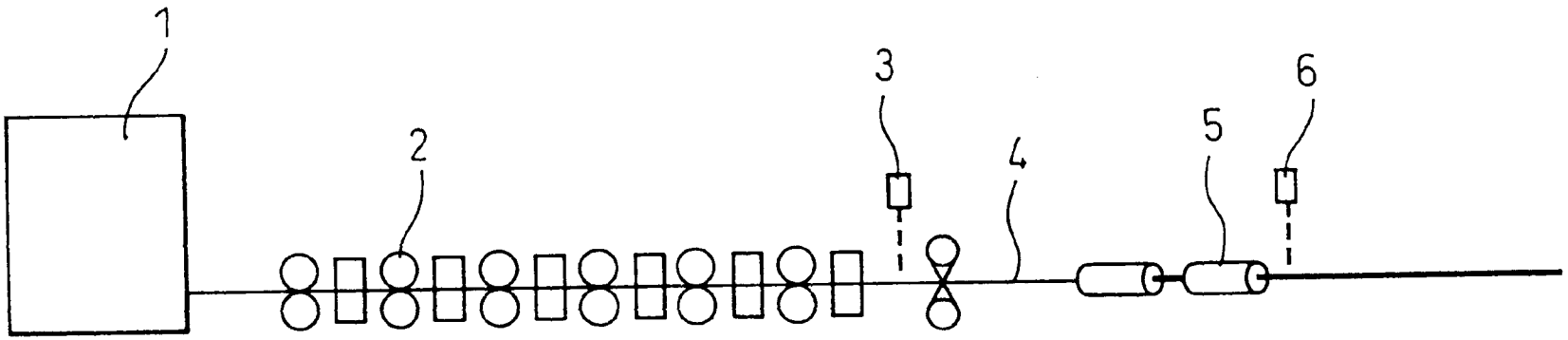
FIG. 4 is a schematic illustration showing an example of a rolling line employed in the present invention.

FIG. 4 is a schematic illustration showing an example of a rolling line employed in the present invention.

As seen in the figure, a steel having a chemical composition according to any of claims 1 to 5 is heated in a reheating furnace 1 and finish rolled through a rolling mill train 2, in a manner to control the surface temperature of the steel bar or wire rod to 700 to 1,000° C. at the exit from the final rolling mill stand. The temperature at the exit from the final rolling mill stand is measured with a pyrometer 3. Then the finish-rolled steel bar or wire rod 4 is rapidly cooled (preferably, at an average cooling rate of, for example, 30° C./sec. or higher) to a surface temperature of 600° C. or lower, preferably 500° C. or lower, or more preferably 400° C. or lower, with water directly applied to its surface through cooling troughs 5, so that the surface structure may consist mainly of martensite. After passing through the cooling troughs, the surface temperature of the steel bar or wire rod is recuperated to 200 to 700° C. (measured with a pyrometer 6) by the sensible heat of its center portion so that the surface structure may consist mainly of tempered martensite.

The present invention provides that the above process cycle of rapid cooling and recuperation is conducted at least once or more. This remarkably enhances steel ductility.

The reason why the surface temperature of the steel material is controlled to 700 to 1,000° C. is that low temperature rolling can fine crystal grains and the, structure after rapid cooling. When the temperature is 1,000° C. or lower, the austenite grain size number in the surface layer is 8; when it is 950° C. or lower, the grain size number is 9; and when it is 860° C. or lower, the grain size number is 10. When the surface temperature is below 700° C., however, it becomes difficult to reduce the quantity of ferrite in the surface layer, and, for this reason, the surface temperature has to be 700° C. or above.

Note that the direct surface quenching method (DSQ) and the apparatus employed in the present invention are publicly known and were disclosed in Japanese Unexamined Patent Publications No. S62-13523 and No. H1-25918, though the objects of the production in those publications are different from those of the present invention.

Figure 5A:
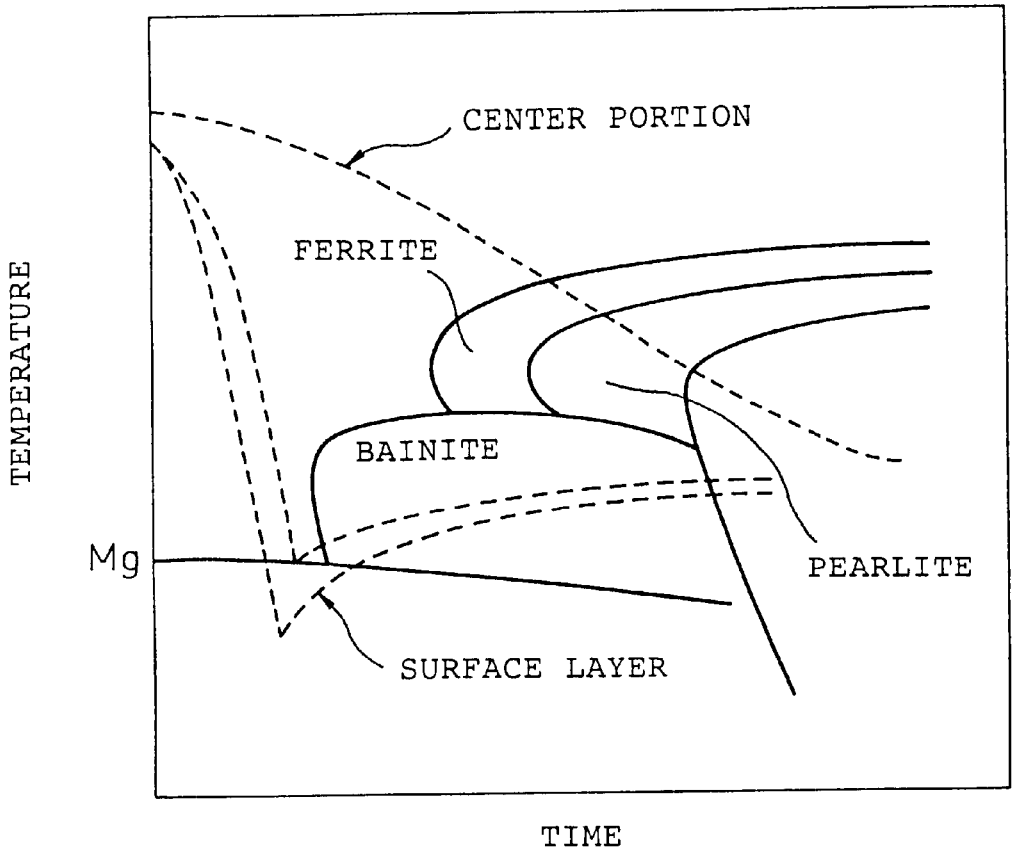
FIG. 5(*a*) is a diagram showing CCT curves to explain the structures of the surface layer and the center portion of a steel bar or wire rod and FIG. 5(*b*) a sectional view showing the structures of a steel bar or wire rod after cooling and recuperation.
Figure 5B:
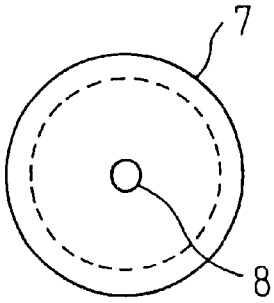

FIG. 5 is a diagram showing CCT curves for explaining the structures of the surface layer and the center portion of a steel bar or wire rod.

As shown in the figure, when a steel bar or wire rod finish-rolled at a low temperature is rapidly cooled and then recuperated, the structure of the surface layer 7 mainly consists of tempered martensite since the surface layer is cooled more rapidly, while the structure of the center portion 8 consists of ferrite and pearlite since the center portion is cooled more slowly than the surface layer.

The object of lowering the surface temperature to 600° C. or below by rapid cooling and then recuperating the surface temperature to 200 to 700° C. by the sensible heat is to make the structure of the surface layer mainly consist of tempered martensite having reduced hardness.

EXAMPLE

Examples of the present invention are explained hereafter.

The steels listed in Tables 1 and 2 were rolled into steel bars and wire rods under the rolling conditions listed in Table 3. The diameters of the rolled products ranged from 36 to 55 mm. The rolled products then underwent spheroidizing annealing and hardening treatment through quenching and tempering. The metallographic structure and material properties of the products were investigated in the as rolled, as spheroidizing-annealed and as quenched and tempered states. The results are shown in Table 3.

"The portion from the surface to the depth of 0.15 times the radius of the steel bar or wire rod" specified in Claims of the present invention is expressed simply as "surface layer" (e.g., surface layer hardness) in Tables 4 to 6. Likewise, "the portion from the depth of 0.5 times the radius to the center" specified in Claims of the present invention is expressed simply as "center portion" (e.g., center portion hardness) in the tables. The deformation resistance was measured through upsetting tests of columnar test pieces having the same diameter as the rolled products and a height 1.5 times the diameter. The critical compressibility was measured through upsetting tests of the columnar test pieces of the same dimension with a notch 0.8 mm in depth and 0.15 mm in notch apex radius on the surfaces. Test pieces for tensile tests were cut out from the positions corresponding to the surface layer of the rolled products, and the tensile strength and reduction of area, which is an indicator of ductility, of the surface layer were measured through tensile tests. The rolled products of each steel grade underwent any one of the common quenching and tempering (common QT), induction hardening and tempering (IQT) and carburization hardening and tempering (CQT). The induction hardening was conducted at a frequency of 30 kHz. The carburization hardening was conducted under the condition of a carbon potential of 0.8% and 950° C.×8 hr.

As is clear from Tables 4 to 6, the examples according to the present invention demonstrate remarkably better values of the critical compressibility and the reduction of area, which are indicators of steel ductility, compared with the comparative examples having the same carbon contents, and their deformation resistance and the hardness after the quenching and tempering are satisfactory.

Next, the steels listed in Table 7 were rolled into steel bars and wire rods 36 to 50 mm in diameter under the rolling conditions listed in Table 3 as in the above examples, spheroidizing-annealed, and then hardened through quenching and tempering. Table 8 shows the investigation results of their structure and material properties. Comparing the examples of Table 8 and the comparative examples of Table 6, the examples according to the present invention demonstrate remarkably better values of the critical compressibility and the reduction of area, which are indicators of steel ductility, compared with the comparative examples having the same carbon contents, and their deformation resistance and the hardness after the quenching and tempering are satisfactory.

TABLE 1

(mass %)

| Classification | Steel | C | Si | Mn | S | Al | B | P | N | O | Ti | Ni | Cr | Mo | Nb | V | Te | Ca |
|---|---|---|---|---|---|---|---|---|---|---|---|---|---|---|---|---|---|---|
| Invented steels | 1 | 0.25 | 0.25 | 1.10 | 0.008 | 0.062 | 0.0020 | 0.020 | 0.0035 | 0.0014 | — | — | — | — | — | — | — | — |
| | 2 | 0.33 | 0.23 | 0.80 | 0.013 | 0.061 | 0.0019 | 0.014 | 0.0044 | 0.0014 | — | — | — | — | — | — | — | — |
| | 3 | 0.43 | 0.24 | 1.34 | 0.009 | 0.060 | 0.0020 | 0.012 | 0.0043 | 0.0007 | — | — | — | — | — | — | | — |
| | 4 | 0.25 | 0.23 | 1.11 | 0.009 | 0.027 | 0.0019 | 0.009 | 0.0042 | 0.0009 | 0.040 | — | — | — | — | — | — | — |
| | 5 | 0.34 | 0.22 | 0.82 | 0.014 | 0.027 | 0.0018 | 0.016 | 0.0045 | 0.0009 | 0.034 | — | — | — | — | — | — | — |
| | 6 | 0.43 | 0.23 | 1.38 | 0.008 | 0.025 | 0.0020 | 0.012 | 0.0048 | 0.0012 | 0.028 | — | — | — | — | — | — | — |
| | 7 | 0.35 | 0.04 | 1.08 | 0.011 | 0.033 | 0.0020 | 0.014 | 0.0045 | 0.0008 | 0.033 | | — | — | — | — | — | — |
| | 8 | 0.45 | 0.04 | 1.01 | 0.009 | 0.028 | 0.0019 | 0.011 | 0.0042 | 0.0010 | 0.028 | — | — | — | — | — | — | — |
| | 9 | 0.48 | 0.04 | 1.04 | 0.012 | 0.030 | 0.0020 | 0.012 | 0.0047 | 0.0011 | 0.026 | — | — | — | — | — | — | — |
| | 10 | 0.53 | 0.04 | 1.02 | 0.007 | 0.029 | 0.0020 | 0.012 | 0.0045 | 0.0012 | 0.027 | — | — | — | — | — | — | — |
| | 11 | 0.25 | 0.24 | 0.51 | 0.008 | 0.059 | 0.0018 | 0.009 | 0.0038 | 0.0008 | — | — | 0.70 | — | — | — | — | — |
| | 12 | 0.45 | 0.04 | 0.30 | 0.006 | 0.064 | 0.0020 | 0.014 | 0.0036 | 0.0007 | — | — | 0.27 | — | — | — | — | — |
| | 13 | 0.53 | 0.04 | 0.31 | 0.010 | 0.063 | 0.0018 | 0.008 | 0.0048 | 0.0013 | — | — | 0.28 | — | — | — | — | — |
| | 14 | 0.40 | 0.05 | 0.38 | 0.009 | 0.062 | 0.0019 | 0.012 | 0.0038 | 0.0013 | — | — | 0.16 | — | — | — | — | — |
| | 16 | 0.24 | 0.25 | 0.52 | 0.007 | 0.028 | 0.0019 | 0.009 | 0.0038 | 0.0007 | 0.038 | — | 0.71 | — | — | — | — | — |
| | 17 | 0.33 | 0.24 | 0.85 | 0.011 | 0.028 | 0.0019 | 0.014 | 0.0045 | 0.0009 | 0.030 | — | 0.12 | — | — | — | | — |
| | 18 | 0.43 | 0.25 | 1.31 | 0.006 | 0.025 | 0.0021 | 0.012 | 0.0047 | 0.0011 | 0.026 | — | 0.12 | — | — | — | — | — |
| | 19 | 0.40 | 0.24 | 0.82 | 0.012 | 0.028 | 0.0019 | 0.012 | 0.0039 | 0.0012 | 0.030 | — | 1.14 | — | — | — | — | — |
| | 20 | 0.35 | 0.25 | 0.81 | 0.008 | 0.028 | 0.0018 | 0.011 | 0.0046 | 0.0009 | 0.034 | — | 1.04 | 0.16 | — | — | — | — |
| | 21 | 0.35 | 0.05 | 0.31 | 0.010 | 0.027 | 0.0021 | 0.008 | 0.0043 | 0.0008 | 0.034 | | 0.30 | — | — | — | — | — |
| | 22 | 0.45 | 0.04 | 0.30 | 0.007 | 0.028 | 0.0019 | 0.013 | 0.0045 | 0.0012 | 0.031 | — | 0.31 | — | — | — | — | — |
| | 23 | 0.53 | 0.05 | 0.30 | 0.000 | 0.029 | 0.0020 | 0.010 | 0.0051 | 0.0010 | 0.029 | — | 0.30 | — | — | — | — | — |
| | 24 | 0.58 | 0.04 | 0.28 | 0.007 | 0.091 | 0.0022 | 0.010 | 0.0047 | 0.0009 | 0.031 | — | 0.31 | — | — | — | — | — |
| | 25 | 0.35 | 0.04 | 0.41 | 0.010 | 0.027 | 0.0018 | 0.011 | 0.0046 | 0.0010 | 0.030 | — | 1.04 | 0.16 | — | — | — | — |
| | 26 | 0.40 | 0.05 | 0.40 | 0.011 | 0.030 | 0.0019 | 0.012 | 0.0049 | 0.0013 | 0.032 | — | 1.02 | — | — | — | — | — |
| | 27 | 0.32 | 0.05 | 0.34 | 0.007 | 0.028 | 0.0020 | 0.015 | 0.0049 | 0.0014 | | — | — | — | 0.018 | 0.15 | — | — |
| | 28 | 0.40 | 0.04 | 1.01 | 0.009 | 0.028 | 0.0019 | 0.011 | 0.0042 | 0.0010 | 0.028 | — | — | — | — | — | 0.0024 | — |
| | 29 | 0.45 | 0.04 | 1.14 | 0.012 | 0.030 | 0.0020 | 0.012 | 0.0047 | 0.0011 | 0.026 | — | — | — | 0.020 | — | 0.0030 | — |
| | 30 | 0.45 | 0.05 | 0.30 | 0.007 | 0.030 | 0.0019 | 0.012 | 0.0037 | 0.0011 | 0.030 | — | 0.30 | — | | — | 0.0031 | — |
| | 31 | 0.43 | 0.23 | 1.35 | 0.012 | 0.031 | 0.0020 | 0.013 | 0.0047 | 0.0012 | 0.027 | — | 0.11 | — | — | — | 0.0025 | — |
| | 32 | 0.40 | 0.25 | 0.80 | 0.007 | 0.027 | 0.0020 | 0.012 | 0.0038 | 0.0013 | 0.030 | — | 1.12 | — | — | — | 0.0026 | — |

TABLE 2

| Classification | Steel | C | Si | Mn | S | Al | B | P | N | O | Ti | Ni | Cr | Mo | Nb | V | Te | Ca |
|---|---|---|---|---|---|---|---|---|---|---|---|---|---|---|---|---|---|---|
| Invented steels | 33 | 0.20 | 0.25 | 0.81 | 0.007 | 0.060 | 0.0021 | 0.012 | 0.0039 | 0.0008 | — | — | 1.12 | | — | — | — | — |
| | 34 | 0.15 | 0.23 | 0.79 | 0.010 | 0.069 | 0.0020 | 0.014 | 0.0039 | 0.0013 | — | — | 1.07 | 0.17 | — | | — | — |
| | 35 | 0.20 | 0.04 | 0.40 | 0.009 | 0.061 | 0.0021 | 0.012 | 0.0041 | 0.0010 | — | — | 1.10 | 0.04 | — | — | | — |
| | 36 | 0.20 | 0.25 | 0.81 | 0.011 | 0.030 | 0.0021 | 0.012 | 0.0048 | 0.0008 | 0.040 | — | 1.10 | — | — | — | — | — |
| | 37 | 0.15 | 0.23 | 0.79 | 0.007 | 0.029 | 0.0020 | 0.014 | 0.0036 | 0.0013 | 0.038 | — | 1.12 | 0.17 | — | — | — | — |
| | 38 | 0.20 | 0.04 | 0.40 | 0.009 | 0.031 | 0.0021 | 0.012 | 0.0048 | 0.0010 | 0.041 | — | 1.10 | 0.04 | — | — | — | — |
| | 39 | 0.20 | 0.04 | 0.41 | 0.011 | 0.029 | 0.0019 | 0.013 | 0.0040 | 0.0012 | 0.039 | — | 1.11 | 0.16 | — | — | — | — |
| | 40 | 0.20 | 0.05 | 0.41 | 0.007 | 0.028 | 0.0020 | 0.010 | 0.0037 | 0.0009 | 0.038 | 0.54 | 0.44 | 0.16 | — | — | — | — |
| | 41 | 0.20 | 0.04 | 0.41 | 0.011 | 0.065 | 0.0019 | 0.013 | 0.0039 | 0.0012 | — | — | 1.12 | 0.17 | 0.028 | — | — | — |
| | 42 | 0.20 | 0.04 | 0.42 | 0.007 | 0.062 | 0.0021 | 0.012 | 0.0042 | 0.0009 | — | — | 1.14 | 0.05 | 0.029 | — | — | — |
| | 43 | 0.19 | 0.24 | 0.84 | 0.007 | 0.030 | 0.0020 | 0.013 | 0.0037 | 0.0009 | 0.032 | — | 1.13 | — | 0.024 | — | — | — |
| | 44 | 0.20 | 0.26 | 0.82 | 0.012 | 0.029 | 0.0020 | 0.011 | 0.0038 | 0.0011 | 0.030 | — | 1.11 | 0.16 | 0.023 | — | — | — |
| | 45 | 0.20 | 0.04 | 0.42 | 0.007 | 0.031 | 0.0021 | 0.012 | 0.0044 | 0.0010 | 0.030 | — | 1.08 | 0.05 | 0.023 | — | — | — |
| | 46 | 0.20 | 0.04 | 0.42 | 0.010 | 0.029 | 0.0019 | 0.013 | 0.0041 | 0.0009 | 0.029 | — | 1.09 | 0.17 | 0.022 | — | — | — |
| | 47 | 0.19 | 0.05 | 0.42 | 0.006 | 0.031 | 0.0019 | 0.012 | 0.0037 | 0.0010 | 0.031 | 0.60 | 0.46 | 0.17 | 0.022 | — | — | — |
| | 48 | 0.20 | 0.05 | 0.40 | 0.009 | 0.031 | 0.0021 | 0.012 | 0.0048 | 0.0010 | 0.035 | — | 1.10 | — | 0.17 | 0.107 | — | — |
| | 49 | 0.19 | 0.24 | 0.84 | 0.012 | 0.030 | 0.0020 | 0.013 | 0.0038 | 0.0009 | 0.041 | — | 1.13 | — | — | — | 0.0028 | — |
| | 50 | 0.15 | 0.04 | 0.43 | 0.008 | 0.029 | 0.0019 | 0.011 | 0.0040 | 0.0012 | 0.029 | — | 1.09 | 0.04 | 0.023 | — | — | 0.0030 |
| | 51 | 0.20 | 0.05 | 0.42 | 0.013 | 0.030 | 0.0022 | 0.013 | 0.0037 | 0.0011 | 0.030 | — | 1.12 | 0.04 | 0.021 | — | 0.025 | — |
| | 52 | 0.19 | 0.04 | 0.44 | 0.007 | 0.029 | 0.0020 | 0.011 | 0.0038 | 0.0010 | 0.029 | — | 1.11 | 0.05 | 0.025 | | 0.023 | 0.0029 |
| | 53 | 0.48 | 0.04 | 0.30 | 0.006 | 0.030 | 0.0020 | 0.012 | 0.0040 | 0.0011 | — | — | — | — | — | — | | — |
| | 54 | 0.53 | 0.04 | 0.31 | 0.008 | 0.029 | 0.0019 | 0.012 | 0.0037 | 0.0012 | — | — | — | — | — | — | — | |
| | 55 | 0.47 | 0.05 | 0.29 | 0.007 | 0.028 | 0.0020 | 0.012 | 0.0040 | 0.0011 | 0.025 | — | — | — | — | — | — | — |
| | 56 | 0.53 | 0.04 | 0.30 | 0.008 | 0.029 | 0.0020 | 0.012 | 0.0038 | 0.0012 | 0.027 | — | — | — | — | — | — | — |
| Comparative steels | 57 | 0.34 | 0.22 | 0.80 | 0.013 | 0.029 | — | 0.014 | 0.0042 | 0.0014 | — | — | — | — | — | — | — | — |
| | 58 | 0.45 | 0.23 | 0.78 | 0.008 | 0.030 | — | 0.012 | 0.0051 | 0.0009 | — | — | — | — | — | — | — | — |
| | 59 | 0.53 | 0.23 | 0.74 | 0.009 | 0.027 | | 0.009 | 0.0050 | 0.0009 | — | — | — | — | — | — | — | — |
| | 60 | 0.40 | 0.25 | 0.82 | 0.009 | 0.030 | — | 0.009 | 0.0054 | 0.0013 | — | — | 1.06 | — | — | — | — | — |
| | 61 | 0.35 | 0.23 | 0.79 | 0.010 | 0.026 | — | 0.013 | 0.0046 | 0.0015 | — | — | 1.03 | 0.17 | — | — | — | — |
| | 62 | 0.20 | 0.24 | 0.82 | 0.010 | 0.030 | — | 0.012 | 0.0152 | 0.0007 | — | — | 1.12 | — | — | — | — | — |
| | 63 | 0.15 | 0.22 | 0.80 | 0.013 | 0.029 | — | 0.014 | 0.0134 | 0.0013 | — | — | 1.10 | 0.16 | — | — | — | — |

TABLE 3

| Classification | Rolling condition | Steel surface temperature at exit from finish rolling ° C. | Number of rapid cooling-recuperation cycles | Steel surface temperature immediately after rapid cooling (average temperature in case of II) | Recuperation temperature (average temperature in case of II) |
|---|---|---|---|---|---|
| Examples of present Invention | I | 740–960 | 1 | About 200° C. | 400–600° C. |
| | II | 750–950 | 7 | About 500° C. | 390–660 |
| Comparative examples | III | 880–950 | | Air-cooled after hot rolling | |

TABLE 4

| Classification | Level | Steel No. | Rolling condition | Structure and properties of bar or wire rod: Area percentage of ferrite in surface layer % | Surface layer hardness HV | Center portion hardness HV | Hardness difference between surface layer and center portion HV | γ grain size number of surface layer |
|---|---|---|---|---|---|---|---|---|
| Specification range of invention | | | | ≦10% | | | ≧20 | ≧8 |
| Examples of invention 1 | 1 | 1 | I | 4 | 220 | 164 | 56 | |
| | 2 | 53 | I | 0 | 268 | 203 | 65 | |
| | 3 | 54 | I | 0 | 312 | 225 | 87 | |
| Examples of invention 2 | 4 | 6 | I | 0 | 276 | 195 | 81 | |
| | 5 | 10 | I | 0 | 312 | 225 | 87 | |
| | 6 | 55 | I | 0 | 270 | 205 | 65 | |

TABLE 4-continued

| | | | | | | | |
|---|---|---|---|---|---|---|---|
| | 7 | 56 | II | 0 | 312 | 225 | 87 |
| Examples | 8 | 13 | I | 0 | 312 | 225 | 87 |
| of inven- | 9 | 17 | I | 0 | 264 | 199 | 65 |
| tion 3 | 10 | 22 | I | 0 | 266 | 185 | 81 |
| | 11 | 24 | II | 0 | 299 | 228 | 71 |
| Examples | 12 | 27 | I | 0 | 297 | 234 | 63 |
| of inven- | | | | | | | |
| tion 4 | | | | | | | |
| Examples | 13 | 29 | I | 0 | 272 | 203 | 69 |
| of inven- | 14 | 32 | I | 0 | 273 | 206 | 67 |
| tion 5 | | | | | | | |
| Examples | 15 | 33 | I | 0 | 341 | 232 | 109 |
| of inven- | 16 | 37 | I | 0 | 323 | 222 | 101 |
| tion 3 | 17 | 39 | I | 0 | 323 | 210 | 113 |
| Examples | 18 | 41 | II | 0 | 340 | 238 | 102 |
| of inven- | 19 | 43 | I | 0 | 315 | 212 | 103 |
| tion 4 | 20 | 46 | I | 0 | 277 | 200 | 77 |
| Examples | 21 | 50 | I | 0 | 302 | 214 | 88 |
| of inven- | | | | | | | |
| tion 5 | | | | | | | |

| | Structure and properties after spheroidizing annealing | | | | | | | | | | |
|---|---|---|---|---|---|---|---|---|---|---|---|
| | Degree of spherio-dized structure | Degree of spherio-dized structure | Ferrite grain size number | Defor-mation | Critical | Surface layer | Tensile | Reduc-tion | Surface hardness after QT HV | | |
| Classification | of surface layer | of center portion | of surface layer | resis-tance MPa | compress-ibility % | hard-ness HV | strength MPa | of area % | Common QT | IQT | CQT |
| Specification range of invention | ≦No. 2 | ≦No. 3 | ≧8 | | | | | | | | |
| Examples | | | | 630 | 62.4 | 115 | 350 | 92 | 231 | | |
| of inven- | | | | 720 | 56.5 | 131 | 483 | 77 | | 650 | |
| tion 1 | | | | 763 | 51.2 | 147 | 553 | 73 | | 698 | |
| Examples | | | | 709 | 57.3 | 127 | 462 | 82 | | 639 | |
| of inven- | | | | 763 | 51.2 | 147 | 523 | 74 | | 696 | |
| tion 2 | | | | 720 | 56.5 | 131 | 483 | 78 | | 650 | |
| | | | | 753 | 51.2 | 147 | 553 | 74 | | 694 | |
| Examples | | | | 763 | 51.2 | 147 | 533 | 74 | | 696 | |
| of inven- | | | | 658 | 57.3 | 128 | 418 | 88 | | 622 | |
| tion 3 | | | | 705 | 57.3 | 127 | 462 | 82 | | 639 | |
| | | | | 750 | 53.2 | 139 | 522 | 73 | | 692 | |
| Examples | | | | 738 | 52.5 | 139 | 520 | 72 | | 924 | |
| of inven- | | | | | | | | | | | |
| tion 4 | | | | | | | | | | | |
| Examples | | | | 748 | 54.4 | 142 | 513 | 76 | | 682 | |
| of inven- | | | | 744 | 55.2 | 128 | 471 | 82 | | 657 | |
| tion 5 | | | | | | | | | | | |
| Examples | | | | 655 | 60.8 | 119 | 408 | 91 | | | 804 |
| of inven- | | | | 647 | 62.2 | 112 | 403 | 91 | | | 802 |
| tion 3 | | | | 627 | 61.0 | 115 | 404 | 92 | | | 811 |
| Examples | | | | 632 | 63.4 | 118 | 407 | 92 | | | 801 |
| of inven- | | | | 644 | 61.8 | 121 | 405 | 92 | | | 778 |
| tion 4 | | | | 645 | 62.4 | 119 | 411 | 91 | | | 780 |
| Examples | | | | 651 | 62.6 | 121 | 409 | 91 | | | 805 |
| of inven- | | | | | | | | | | | |
| tion 5 | | | | | | | | | | | |

TABLE 5

| Classification | Level | Steel No. | Rolling condition | Structure and properties of bar or wire rod: Area percentage of ferrite in surface layer % | Surface layer hardness HV | Center portion hardness HV | Hardness difference between surface layer and center portion HV | γ grain size number of surface layer |
|---|---|---|---|---|---|---|---|---|
| Specification range of invention | | | | ≦10% | | | ≧20 | ≧8 |
| Examples of invention 6 | 22 | 3 | I | 0 | 266 | 185 | 81 | 10.4 |
| | 23 | 4 | I | 4 | 203 | 147 | 56 | 10.9 |
| | 24 | 7 | I | 3 | 262 | 200 | 62 | 10.5 |
| | 25 | 14 | I | 0 | 265 | 197 | 68 | 10.2 |
| | 26 | 19 | II | 0 | 275 | 207 | 68 | 9.9 |
| | 27 | 23 | I | 0 | 302 | 215 | 87 | 10.8 |
| | 28 | 28 | I | 0 | 284 | 211 | 73 | 9.5 |
| | 29 | 31 | I | 0 | 272 | 203 | 69 | 10.4 |
| | 30 | 34 | I | 0 | 323 | 222 | 101 | 11.8 |
| | 31 | 36 | I | 0 | 341 | 232 | 109 | 10.8 |
| | 32 | 44 | II | 0 | 340 | 238 | 102 | 11.2 |
| | 33 | 52 | I | 0 | 302 | 214 | 88 | 10.4 |
| Examples of invention 8 | 34 | 2 | I | 3 | 262 | 200 | 62 | |
| | 35 | 5 | I | 3 | 262 | 200 | 62 | |
| | 36 | 8 | I | 0 | 266 | 185 | 81 | |
| | 37 | 11 | I | 4 | 203 | 147 | 56 | |
| | 38 | 15 | I | 0 | 261 | 199 | 63 | 10.4 |
| | 39 | 18 | I | 0 | 266 | 185 | 81 | |
| | 40 | 21 | I | 3 | 262 | 200 | 62 | |
| | 41 | 26 | I | 0 | 271 | 199 | 63 | 10.4 |
| | 42 | 35 | I | 0 | 335 | 226 | 109 | |
| | 43 | 45 | II | 0 | 285 | 200 | 85 | |
| | 44 | 48 | II | 0 | 275 | 205 | 70 | 9.2 |
| | 45 | 51 | I | 0 | 302 | 214 | 88 | |

| Classification | Structure and properties after spheroidizing annealing: Degree of spheriodized structure of surface layer | Degree of spheriodized structure of center portion | Ferrite grain size number of surface layer | Deformation resistance MPa | Critical compressibility % | Surface layer hardness HV | Tensile strength MPa | Reduction of area % | Surface hardness after QT HV: Common QT | IQT | CQT |
|---|---|---|---|---|---|---|---|---|---|---|---|
| Specification range of invention | ≦No. 2 | ≦No. 3 | ≧8 | | | | | | | | |
| Examples of invention 6 | | | | 699 | 58.3 | 128 | 462 | 83 | | 639 | |
| | | | | 620 | 61.4 | 117 | 402 | 93 | 232 | | |
| | | | | 660 | 59.2 | 125 | 415 | 89 | | 620 | |
| | | | | 742 | 56.4 | 128 | 473 | 84 | | 653 | |
| | | | | 742 | 57.4 | 128 | 473 | 84 | | 653 | |
| | | | | 763 | 52.2 | 147 | 539 | 75 | | 689 | |
| | | | | 735 | 56.2 | 124 | 466 | 83 | | 658 | |
| | | | | 738 | 54.4 | 140 | 513 | 77 | | 682 | |
| | | | | 647 | 62.2 | 122 | 423 | 91 | | | 802 |
| | | | | 655 | 60.8 | 119 | 418 | 91 | | | 804 |
| | | | | 632 | 62.4 | 115 | 417 | 90 | | | 801 |
| | | | | 651 | 62.6 | 120 | 419 | 91 | | | 805 |
| Examples of invention 8 | 1 | 2 | | 660 | 57.2 | 124 | 415 | 87 | | 620 | |
| | 1 | 2 | | 660 | 57.2 | 124 | 415 | 88 | | 620 | |
| | 1 | 2 | | 699 | 56.3 | 128 | 462 | 82 | | 639 | |
| | 1 | 2 | | 620 | 61.4 | 115 | 394 | 92 | 233 | | |
| | 1 | 2 | | 662 | 57.3 | 126 | 403 | 84 | | 620 | |
| | 1 | 2 | | 709 | 58.9 | 123 | 462 | 82 | | 639 | |
| | 1 | 2 | | 660 | 57.2 | 124 | 415 | 84 | | 620 | |
| | 1 | 2 | | 662 | 57.3 | 124 | 423 | 87 | | 615 | |
| | 1 | 2 | | 657 | 60.2 | 124 | 422 | 90 | | | 812 |
| | 1 | 2 | | 635 | 61.3 | 121 | 416 | 91 | | | 794 |
| | 1 | 2 | | 644 | 61.6 | 120 | 422 | 87 | | | 795 |
| | 1 | 2 | | 651 | 62.6 | 120 | 419 | 89 | | | 805 |

TABLE 6

| Classification | Level | Steel No. | Rolling condition | Structure and properties of bar or wire rod: Area percentage of ferrite in surface layer % | Surface layer hardness HV | Center portion hardness HV | Hardness difference between surface layer and center portion HV | γ grain size number of surface layer |
|---|---|---|---|---|---|---|---|---|
| Specification range of invention | | | | ≦10% | | | ≧20 | ≧8 |
| Examples of invention 9 | 46 | 9 | I | 0 | 270 | 205 | 85 | |
| | 47 | 12 | I | 0 | 256 | 185 | 81 | |
| | 48 | 16 | I | 0 | 261 | 200 | 61 | |
| | 49 | 20 | I | 0 | 261 | 199 | 63 | 10.7 |
| | 50 | 25 | I | 0 | 275 | 207 | 68 | |
| | 51 | 30 | I | 0 | 267 | 186 | 81 | |
| | 52 | 38 | II | 0 | 321 | 211 | 110 | |
| | 53 | 40 | I | 0 | 345 | 236 | 109 | |
| | 54 | 42 | I | 0 | 325 | 222 | 103 | |
| | 55 | 47 | II | 0 | 335 | 226 | 100 | |
| | 56 | 49 | I | 0 | 325 | 220 | 105 | 10.0 |
| Comparative examples | 57 | 57 | III | 62 | 191 | 183 | 8 | |
| | 58 | 58 | III | 47 | 215 | 207 | 8 | |
| | 59 | 59 | III | 34 | 224 | 219 | 5 | |
| | 60 | 60 | III | 30 | 255 | 244 | 11 | |
| | 61 | 61 | III | 26 | 272 | 358 | 14 | |
| | 62 | 62 | III | 52 | 199 | 192 | 7 | |
| | 63 | 63 | III | 36 | 224 | 214 | 10 | |

| Classification | Structure and properties after spheroidizing annealing: Degree of spheriodized structure of surface layer | Degree of spheriodized structure of center portion | Ferrite grain size number of surface layer | Deformation resistance MPa | Critical compressibility % | Surface layer hardness HV | Tensile strength MPa | Reduction of area % | Surface hardness after QT HV: Common QT | IQT | CQT |
|---|---|---|---|---|---|---|---|---|---|---|---|
| Specification range of invention | ≦No. 2 | ≦No. 3 | ≧8 | | | | | | | | |
| Examples of invention 9 | 1 | 2 | 10.1 | 710 | 55.5 | 131 | 483 | 78 | | 650 | |
| | 1 | 2 | 10.5 | 709 | 57.3 | 128 | 462 | 92 | | 639 | |
| | 1 | 2 | 9.7 | 638 | 63.8 | 119 | 392 | 92 | 235 | | |
| | 1 | 2 | 10.2 | 652 | 57.3 | 124 | 423 | 88 | | 614 | |
| | 1 | 2 | 9.9 | 742 | 55.4 | 128 | 373 | 83 | | 653 | |
| | 1 | 2 | 9.8 | 712 | 57.2 | 130 | 478 | 80 | | 641 | |
| | 1 | 2 | 10.3 | 635 | 62.4 | 118 | 417 | 91 | | | 809 |
| | 1 | 2 | 10.4 | 647 | 60.2 | 120 | 412 | 90 | | | 812 |
| | 1 | 2 | 9.7 | 634 | 61.8 | 119 | 405 | 92 | | | 778 |
| | 1 | 2 | 9.9 | 657 | 60.2 | 119 | 412 | 91 | | | 812 |
| | 1 | 2 | 9.5 | 643 | 61.6 | 121 | 415 | 91 | | | 782 |
| Comparative examples | 3 | 4 | | 730 | 46.2 | 153 | 515 | 76 | | 536 | |
| | 3 | 4 | | 769 | 45.3 | 156 | 562 | 70 | | 561 | |
| | 4 | 4 | | 833 | 42.2 | 175 | 633 | 61 | | 592 | |
| | 3 | 4 | | 812 | 45.4 | 157 | 573 | 72 | | 578 | |
| | 2 | 3 | | 732 | 47.3 | 155 | 623 | 71 | | 563 | |
| | 3 | 4 | | 725 | 47.8 | 148 | 528 | 77 | | | 804 |
| | 3 | 4 | | 726 | 47.2 | 151 | 543 | 77 | | | 802 |

Common QT: Quenching at 900° C. + tempering at 550° C.;
IQT: induction hardening + tempering at 170° C.;
CQT: carburization hardening + tempering at 170° C.

TABLE 7

(mass %)

| Steel | C | Si | Mn | S | Al | B | P | N | O | Ti | Cr | Mo | Nb | Te | Zr | Mg | Y | Rare earth element |
|---|---|---|---|---|---|---|---|---|---|---|---|---|---|---|---|---|---|---|
| 71 | 0.45 | 0.04 | 1.30 | 0.014 | 0.058 | 0.0018 | 0.015 | 0.0042 | 0.0013 | — | — | — | | | 0.0024 | — | — | — |
| 72 | 6.43 | 0.04 | 1.05 | 0.008 | 0.034 | 0.0019 | 0.012 | 0.0048 | 0.0009 | 0.026 | — | — | — | 0.0194 | 0.0033 | — | — | — |
| 73 | 0.45 | 0.04 | 0.46 | 0.015 | 0.032 | 0.0021 | 0.014 | 0.0047 | 0.0011 | 0.025 | — | | — | — | — | 0.0158 | — | — |
| 74 | 0.45 | 0.05 | 0.35 | 0.007 | 0.066 | 0.0021 | 0.015 | 0.0040 | 0.0008 | — | 0.28 | | — | — | — | — | — | 0.024 |
| 75 | 0.44 | 0.04 | 0.32 | 0.010 | 0.033 | 0.0019 | 0.012 | 0.0047 | 0.0012 | 0.030 | 0.33 | — | — | | 0.0022 | 0.0172 | — | — |
| 76 | 0.20 | 0.04 | 0.43 | 0.008 | 0.035 | 0.0030 | 0.013 | 0.0044 | 0.0012 | 0.027 | 1.04 | 0.05 | 0.025 | — | 0.0036 | — | — | — |
| 77 | 0.19 | 0.04 | 0.50 | 0.013 | 0.037 | 0.0028 | 0.014 | 0.0046 | 0.0013 | 0.025 | 1.12 | 0.05 | 0.023 | — | | 0.0235 | — | — |
| 78 | 0.45 | 0.04 | 0.48 | 0.013 | 0.035 | 0.0018 | 0.016 | 0.0045 | 0.0012 | 0.024 | — | — | — | — | — | — | 0.018 | — |

TABLE 8

| | | | | Structure and properties of bar or wire rod | | | | |
|---|---|---|---|---|---|---|---|---|
| Classification | Level | Steel No. | Rolling condition | Area percentage of ferrite in surface layer % | Surface layer hardness HV | Center portion hardness HV | Hardness difference between surface layer and center portion HV | γ grain size number of surface layer |
| Specification range of invention | | | | ≦10% | | | ≧20 | ≧8 |
| Examples of invention 8 | 71 | 71 | I | 0 | 268 | 187 | 81 | |
| | 72 | 72 | I | 0 | 263 | 181 | 82 | |
| | 73 | 73 | I | 0 | 269 | 184 | 85 | 9.8 |
| Examples of invention 9 | 74 | 74 | I | 0 | 264 | 181 | 83 | 10.5 |
| | 75 | 75 | I | 0 | 268 | 180 | 88 | 11.3 |
| | 76 | 76 | II | 0 | 287 | 194 | 93 | 10.7 |
| | 77 | 77 | II | 0 | 288 | 195 | 93 | 11.2 |
| | 78 | 78 | I | 0 | 271 | 186 | 85 | 10.0 |

| | Structure and properties after spheroidizing annealing | | | | | | | | Surface hardness after QT HV | | |
|---|---|---|---|---|---|---|---|---|---|---|---|
| Classification | Degree of spheriodized structure of surface layer | Degree of spheriodized structure of center portion | Ferrite grain size number of surface layer | Deformation resistance MPa | Critical compressibility % | Surface layer hardness HV | Tensile strength MPa | Reduction of area % | Common QT | IQT | CQT |
| Specification range of invention | ≦No. 2 | ≦No. 3 | ≧8 | | | | | | | | |
| Examples of invention 8 | 1 | 2 | | 697 | 58.7 | 124 | 460 | 84 | | 642 | |
| | 1 | 2 | | 694 | 56.0 | 129 | 464 | 81 | | 638 | |
| | 1 | 2 | | 695 | 56.6 | 127 | 463 | 83 | 292 | | |
| Examples of invention 9 | 1 | 2 | 9.8 | 701 | 56.8 | 125 | 465 | 90 | | 645 | |
| | 1 | 2 | 10.4 | 707 | 56.8 | 128 | 460 | 83 | | 653 | |
| | 1 | 2 | 10.7 | 632 | 60.8 | 119 | 417 | 90 | | | 802 |
| | 1 | 2 | 9.7 | 637 | 61.0 | 123 | 414 | 93 | | | 807 |
| | 1 | 2 | 10.0 | 698 | 56.0 | 129 | 464 | 82 | 287 | | |

Common QT: Quenching at 900° C. + tempering at 550° C.;
IQT: induction hardening + tempering at 170° C.;
CQT: carburization hardening + tempering at 170° C.

Industrial Applicability

A steel bar or wire rod for cold forging according to the present invention is a steel bar or wire rod for cold forging excellent in ductility after spheroidizing annealing and capable of preventing the occurrence of cracking in the steel material during cold forging, which cracking has so far been a problem in the cold forging after spheroidizing annealing. Since the present invention makes it possible to manufacture forged machine components requiring heavy working by cold forging, it brings about remarkable advantages of great productivity improvement and energy saving.

What is claimed is:

1. A steel bar or wire rod for cold forging excellent in ductility after spheroidizing annealing, having a chemical composition comprising, in mass, 0.1 to 0.65% of C, 0.01 to 0.5% of Si, 0.2 to 1.7% of Mn, 0.001 to 0.15% of S, 0.015 to 0.1% of Al, 0.0005 to 0.007% of B, and the restricted elements of 0.035% or less of P, 0.01% or less of N and 0.003% or less of O, with the balance consisting of Fe and unavoidable impurities, characterized in that: the area percentage of ferrite structure is 10% or less at the portion from the surface to a depth of 0.15 times the radius of the steel bar or wire rod; the other portion consists substantially of one or more of martensite, bainite and pearlite; and further the average hardness of the portion from the depth of 0.5 times its radius to its center is less than the hardness of its surface layer (the portion from the surface to the depth of 0.15 times the radius) by HV 20 or more.

2. A steel bar or wire rod for cold forging excellent in ductility after spheroidizing annealing according to claim 1, characterized by further containing 0.2 mass % or less of Ti.

3. A steel bar or wire rod for cold forging excellent in ductility after spheroidizing annealing according to claim 1, characterized by further containing, by mass, one or more of 3.5% or less of Ni, 2% of less of Cr and 1% or less of Mo.

4. A steel bar or wire rod for cold forging excellent in ductility after spheroidizing annealing according to claim 1, characterized by further containing, by mass, one or both of 0.005 to 0.1% of Nb and 0.03 to 0.3% of V.

5. A steel bar or wire for cold forging excellent in ductility after spheroidizing annealing according to claim 1, characterized by further containing, by mass, one or more of 0.02% or less of Te, 0.02% or less of Ca, 0.01% or less of Zr, 0.35% or less of Mg, 0.1% or less of Y and 0.15% or less of rare earth elements.

6. A method to produce a steel bar or wire rod for cold forging excellent in ductility after spheroidizing annealing, characterized by finish-hot-rolling a steel having a chemical composition specified in claim 1 in a manner to control its surface temperature to 700 to 1,000° C. at the exit from the final finish rolling stand and then subjecting it to at least one or more process cycles consisting of rapid cooling to a surface temperature of 600° C. or below and recuperation by its sensible heat to a surface temperature of 200 to 700° C., so that the area percentage of ferrite structure is 10% or less at the portion from the surface to the depth of 0.15 times the radius of the steel bar or wire rod, the other portion consists substantially of one or more of martensite, bainite and pearlite, and further the average hardness of the portion from the depth of 0.5 times its radius to is center is softer than the hardness of its surface layer (the portion from the surface to the depth of 0.15 times the radius) by HV 20 or more.

7. A steel bar or wire rod for cold forging excellent in ductility after spheroidizing annealing according to claim 1, characterized in that prior to spheroidizing annealing, the portion from the surface to the depth of 0.15 times the radius of the steel bar or wire rod has an austenite phase and the austhenitic grain size is less than 20 $\mu$m.

8. A steel bar or wire rod for cold forging excellent in ductility after spheroidizing annealing according to claim 1, characterized in that the spheroidized structure substantially does not contain lamellar pearlite structure at the portion from the surface to the depth of 0.15 times the radius of the steel bar or wire rod and an area ratio of the lamellar pearlite structure is less than 10% with the remainder spheroidized structure at the portion from the depth of 0.5 times its radius to its center.

9. A steel bar or wire rod for cold forging excellent in ductility according to claim 8, characterized in that ferrite grain size is less than 20 $\mu$m at the portion from the surface to the depth of 0.15 times the radius of the steel bar or wire rod.

* * * * *